US011411306B2

(12) United States Patent
Klein et al.

(10) Patent No.: US 11,411,306 B2
(45) Date of Patent: Aug. 9, 2022

(54) BROAD BAND MONOPOLE ANTENNA

(71) Applicant: AEROANTENNA TECHNOLOGY, INC., Chatsworth, CA (US)

(72) Inventors: Joseph Klein, Chatsworth, CA (US); Keyvan Bahadori, Northridge, CA (US); Vladimir Kimelblat, Chatsworth, CA (US)

(73) Assignee: AEROANTENNA TECHNOLOGY, INC., Chatsworth, CA (US)

( * ) Notice: Subject to any disclaimer, the term of this patent is extended or adjusted under 35 U.S.C. 154(b) by 380 days.

(21) Appl. No.: 16/262,210

(22) Filed: Jan. 30, 2019

(65) Prior Publication Data

US 2020/0243961 A1 Jul. 30, 2020

(51) Int. Cl.

| | |
|---|---|
| ***H01Q 1/48*** | (2006.01) |
| ***H01Q 1/38*** | (2006.01) |
| ***H01Q 1/52*** | (2006.01) |

(52) U.S. Cl.

CPC ..... *H01Q 1/48* (2013.01); *H01Q 1/38* (2013.01); *H01Q 1/521* (2013.01)

(58) Field of Classification Search

CPC ..... H01Q 1/48; H01Q 1/38; H01Q 1/521

See application file for complete search history.

(56) References Cited

U.S. PATENT DOCUMENTS

| | | | | |
|---|---|---|---|---|
| 5,872,546 | A | 2/1999 | Ihara et al. | |
| 6,437,756 | B1 | 8/2002 | Schantz | |
| 6,842,141 | B2 | 1/2005 | Suh et al. | |
| 7,298,346 | B2 | 11/2007 | Heyde et al. | |
| 2016/0372823 | A1 | 12/2016 | Yoon et al. | |
| 2020/0028276 | A1 * | 1/2020 | Watson | H01Q 9/145 |

OTHER PUBLICATIONS

Abstract of "Planar Trapezoidal and Pentagonal Monopoles with Impedance Bandwidths in Excess of 10:1," Evans, et al. IEEE International Symposium, vol. 3, Sep. 1999, all enclosed pages cited.

* cited by examiner

*Primary Examiner* — Seokjin Kim
*Assistant Examiner* — Jianzi Chen
(74) *Attorney, Agent, or Firm* — Burr & Forman, LLP

(57) ABSTRACT

A broad band monopole antenna may include a planar electrically conductive base surface arranged horizontally, a planar polygonal shaped antenna element arranged vertically spaced above the base surface by a distance (D), and a planar polygonal shaped ground plane arranged vertically between the base surface and said antenna element. The ground plane may be electrically connected to the base surface.

20 Claims, 6 Drawing Sheets

BROAD BAND MONOPOLE ANTENNA

TECHNICAL FIELD

Example embodiments generally relate to antennas and, in particular, relate to a broad band monopole antenna.

BACKGROUND

Monopole antennas have a number of advantages for designers. For example, monopole antennas can generally be made with relatively small sizes, and are easy to fabricate. Moreover, monopole antennas generally have a relatively Narrow bandwidth.

FIG. 1 illustrates a schematic drawing of a conventional monopole antenna 100. In this regard, the antenna 100 includes a planar electrically conductive base surface 1 (or ground plane) that is arranged horizontally (e.g., in a horizontal plane). The antenna 100 further includes a polygonal shaped antenna element 2 that is arranged vertically, and extends away from the base surface 1. The antenna 100 also includes a printed circuit board 3 arranged to be vertically extending away from the base surface 1. The polygonal shaped antenna element 2 is formed on the printed circuit board 3.

FIG. 2 illustrates a plot 200 of the voltage standing wave ratio (VSWR) of the antenna 100 of FIG. 1, and FIG. 3 illustrates a plot 300 of the radiation pattern of the antenna 100 at a frequency of 2.7 GHz. FIG. 3 further illustrates gain (dBi), dependence versus inclination angle (in degrees). As can be appreciated from FIGS. 2 and 3, the antenna 100 has a VSWR≤2 only at 0.70-0.96 GHz, which covers only a lower band of the cellular communication frequency range. Accordingly, the antenna 100 has only marginal performance for cellular communication frequencies and, in most cases, cannot be used for applications in the range of about 1.70-2.70 GHz.

In addition to VSWR requirements, cellular communication systems generally require the direction of maximum gain of the antenna 100 to be below 30 degrees of elevation from the horizon. However, for a radiation pattern at frequency 2.7 GHz of the design of FIGS. 1-3, the antenna 100 has a direction of maximum gain at 50 degrees of elevation from the horizon. The direction of maximum gain is mainly controlled by the distance of the high density currents from the ground plane. For the antenna 100, this distance is very short, as the antenna 100 is directly mounted over the ground plane (i.e., base surface 1). Accordingly, the trapezoidal flat monopole antenna has limited bandwidth and very high direction of gain maximum at high frequency.

BRIEF SUMMARY OF SOME EXAMPLES

In an example embodiment, a broad band monopole antenna is provided. The antenna may include a planar electrically conductive base surface arranged horizontally, a planar polygonal shaped antenna element arranged vertically spaced above the base surface by a distance (D), and a planar polygonal shaped ground plane arranged vertically between the base surface and said antenna element. The ground plane may be electrically connected to the base surface.

In another example embodiment, an alternative broad band monopole antenna is provided. The antenna may include a planar electrically conductive base surface arranged horizontally, a planar polygonal shaped antenna element arranged vertically spaced above the base surface by a distance (D), a planar polygonal shaped ground plane arranged vertically between the base surface and the antenna element, and N additional antenna elements, where N is a positive integer. The ground plane may be electrically connected to the base surface, and have N opened areas. One of each of the N additional antenna elements may be installed in each respective one of the N opened areas in the ground plane.

BRIEF DESCRIPTION OF THE SEVERAL VIEWS OF THE DRAWING(S)

Having thus described some example embodiments in general terms, reference will now be made to the accompanying drawings, which are not necessarily drawn to scale, and wherein:

DETAILED DESCRIPTION

Figure 1:
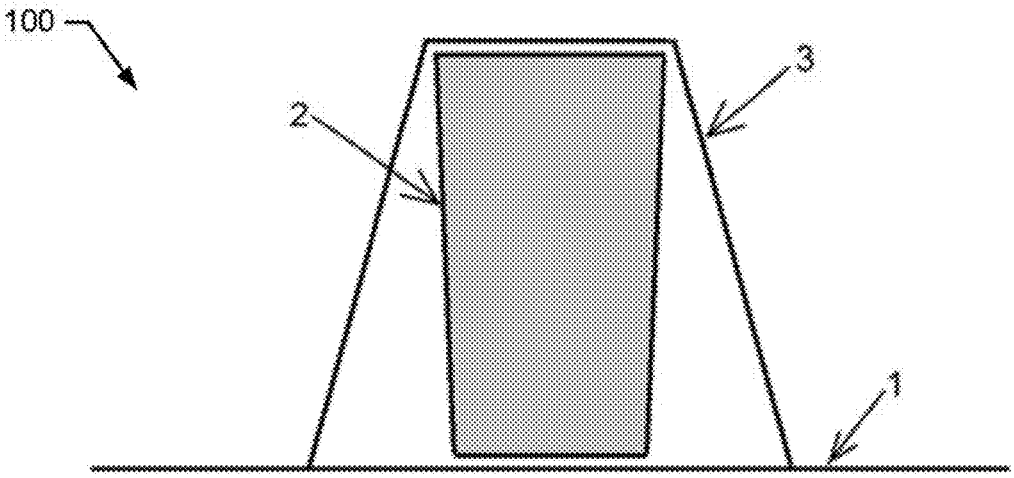
FIG. 1. (Prior Art)
FIG. 1 illustrates a conventional monopole antenna.
Figure 2:
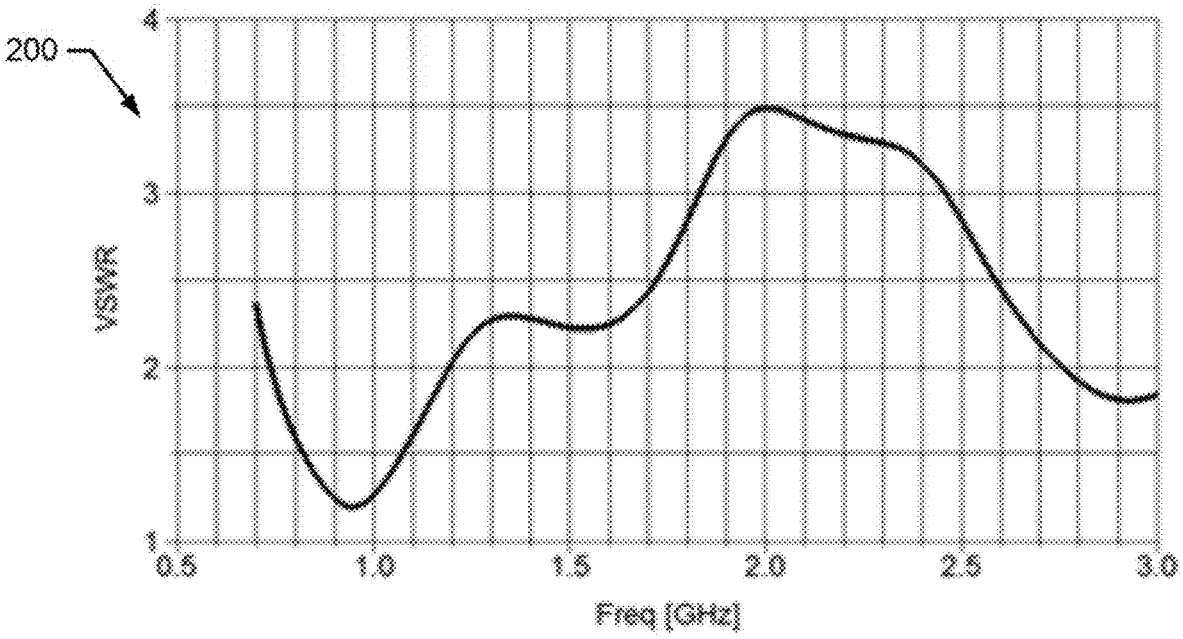
FIG. 2. (Prior Art)
FIG. 2 illustrates a VSWR plot of the antenna of FIG. 1.
Figure 3:
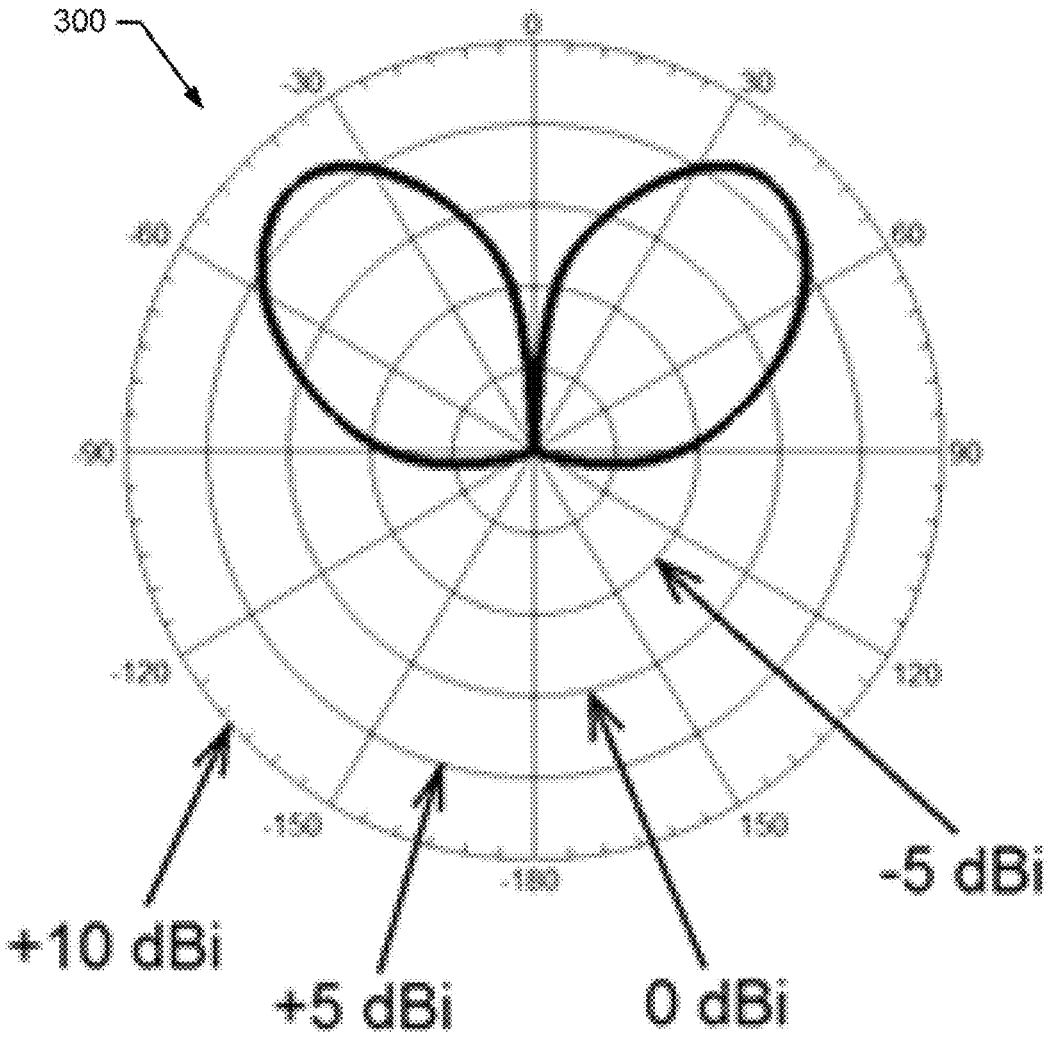
FIG. 3. (Prior Art)
FIG. 3 illustrates a radiation pattern of the antenna of FIG. 1 at a frequency of 2.7 GHz.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Figure 4:
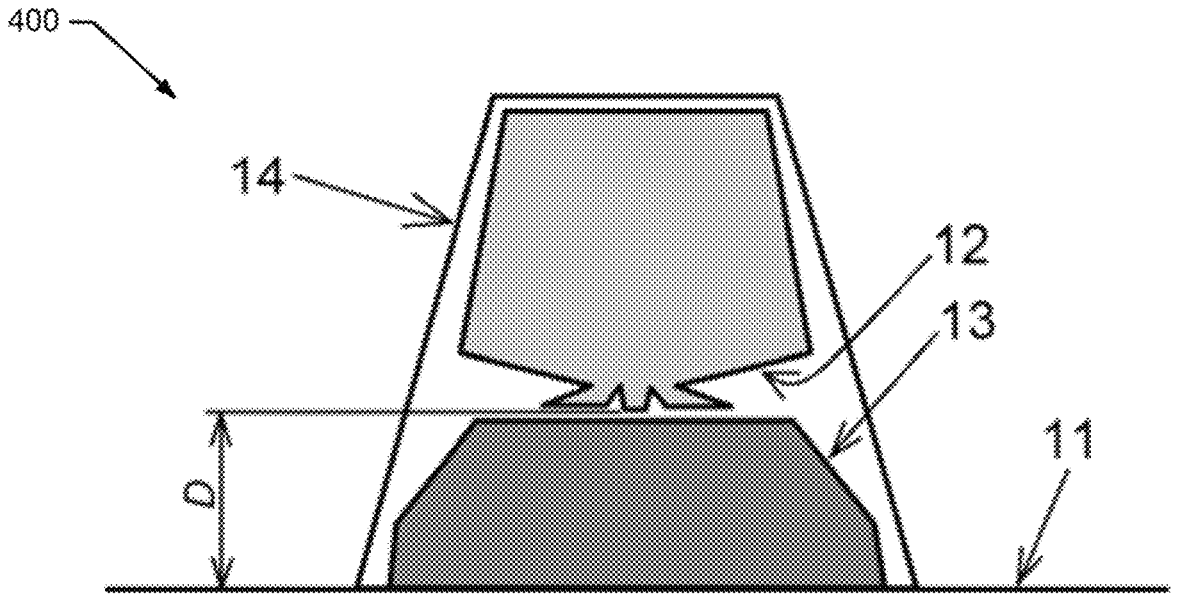
FIG. 4 illustrates a broad band monopole antenna in accordance with an example embodiment.

As shown in FIG. 4, a broad band monopole antenna 400 according to an example embodiment may include a planar electrically conductive base surface 11 arranged horizontally. The antenna 400 may further include a planar polygonal shaped antenna element 12 arranged vertically and spaced apart from the base surface 11 by a distance (D). The antenna 400 further includes a planar polygonal shaped ground plane 13 arranged vertically in the space formed between the base surface 11 and the antenna element 12. Thus, the planar polygonal shaped ground plane 13 is formed to extend away from the base surface by less than the distance (D). The antenna 400 may further include a printed circuit board 14 arranged vertically on the base surface 11. The base surface 11 may, in some examples, have a circular shape with a typical diameter of about 18 inches. The planar ground plane 13 may be operably coupled (e.g., electrically connected) to the base surface 11. The printed circuit board 14 may be made out of glass-reinforced epoxy laminate material (e.g., FR-4) or similar material. The printed circuit board 14 may also be formed to have an isosceles trapezoid shape with dimensions that are selected based on the frequency at which the antenna 400 is designed to operate. For example, if the antenna 400 is configured to operate at about 2.7 GHz, then the thickness of the printed circuit board 14 may be selected to be about 0.028 inches, the height may be about 3.1 inch, and the parallel sides may have lengths of about 1.8 inches (on the top) and about 3.5 inches (on the bottom). In an example embodiment, the antenna element 12 and the ground plane 13 may be placed or otherwise formed on the surface of printed circuit board 14.

The broad band monopole antenna 400 of FIG. 4 may be connected to an output cable via multiple coupling locations. For example, in some cases, the output cable could be operably coupled to a first point defined at a center of the lowest part of antenna element 12. However, a second possible connection point may be a point on the top of ground plane 13, which is the closest one to the first point. The broad band monopole antenna 400 may, in some cases, have exactly the same base surface 11 and printed circuit board 14 as base surface 1 and printed circuit board 3 described above in reference to FIG. 1.

Figure 5:
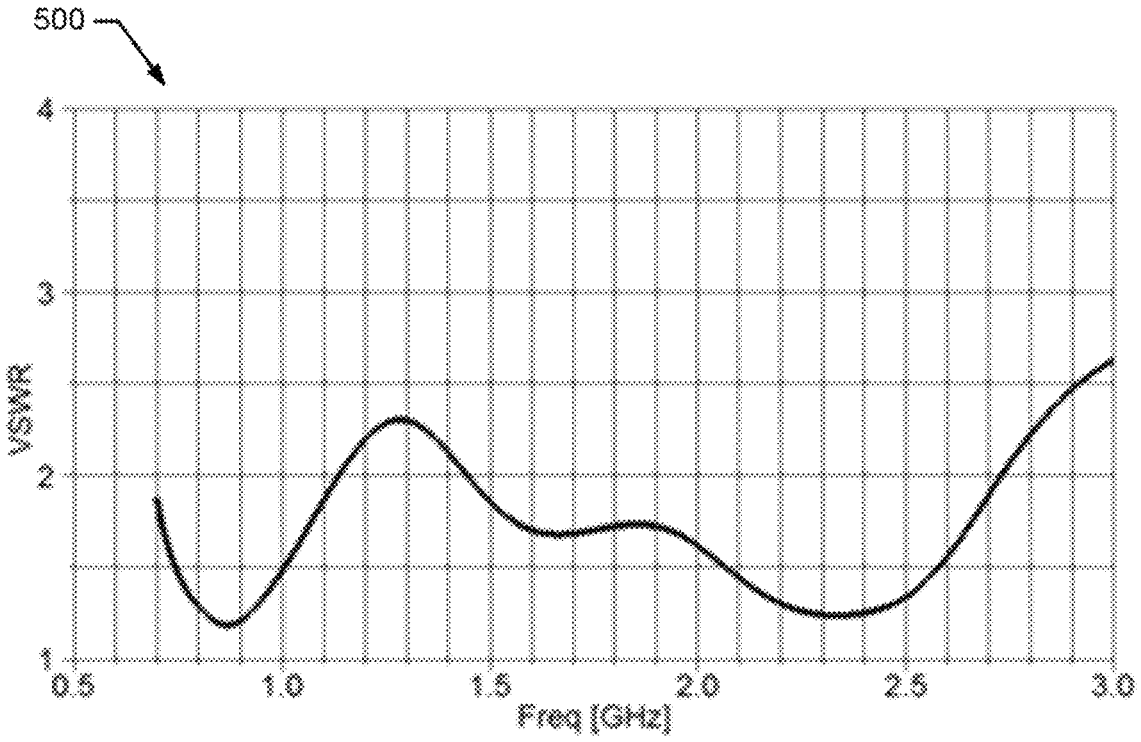
FIG. 5 illustrates a plot of dependence of VSWR vs. frequency for the antenna of FIG. 4 in accordance with an example embodiment.

It may be desirable for the antenna 400 to have VSWR≤2 at frequencies bands 0.70-0.96 GHz and 1.70-2.70 GHz. In this regard, VSWR vs frequency is shown in the plot 500 of FIG. 5 for the broad band monopole antenna 400 across a frequency band of about 0.5-3.0 GHz. As can be appreciated from FIG. 5, the broad band monopole antenna 400 meets the VSWR requirement outlined above.

Figure 6:
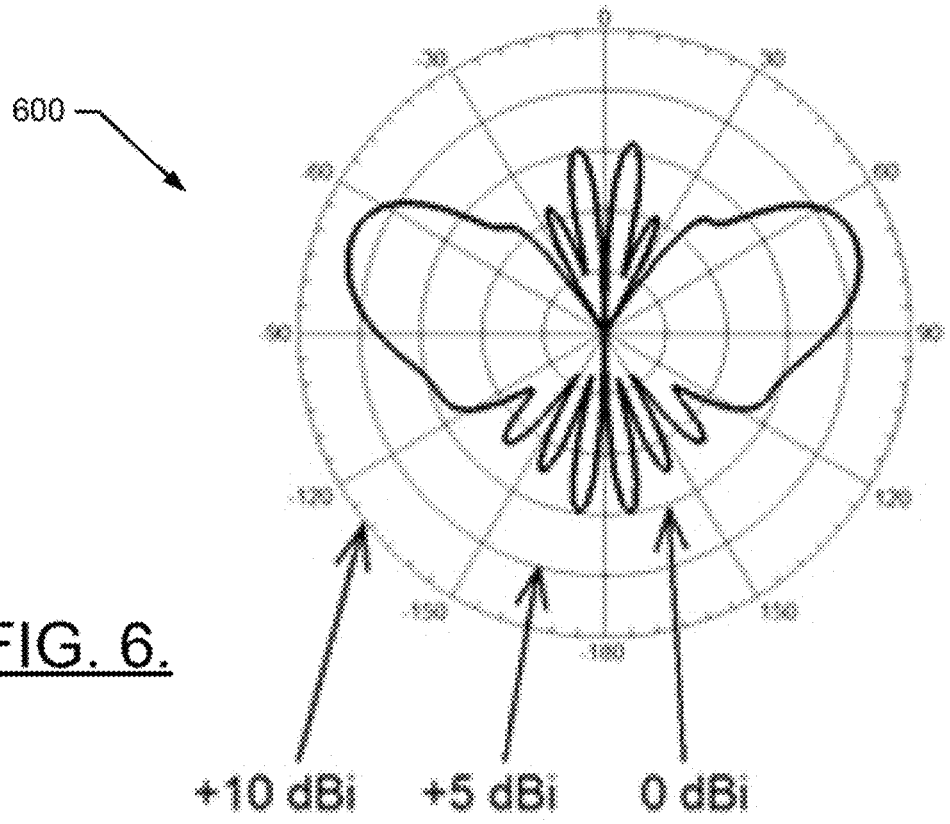
FIG. 6 illustrates a radiation pattern of the antenna of FIG. 4 at a frequency of 2.7 GHz in accordance with an example embodiment.

For some applications, a desirable direction of maximum gain of the antenna 400 should be below about 30 degrees of elevation from the horizon. A radiation pattern 600 of the broad band monopole antenna 400 is shown in FIG. 6. As can be appreciated from FIG. 6, the broad band monopole antenna 400 has a direction of maximum gain at about 20 degrees of elevation from the horizon. Thus, again, the broad band monopole antenna 400 meets this requirement for directionality of maximum gain relative to the horizon.

Figure 7:
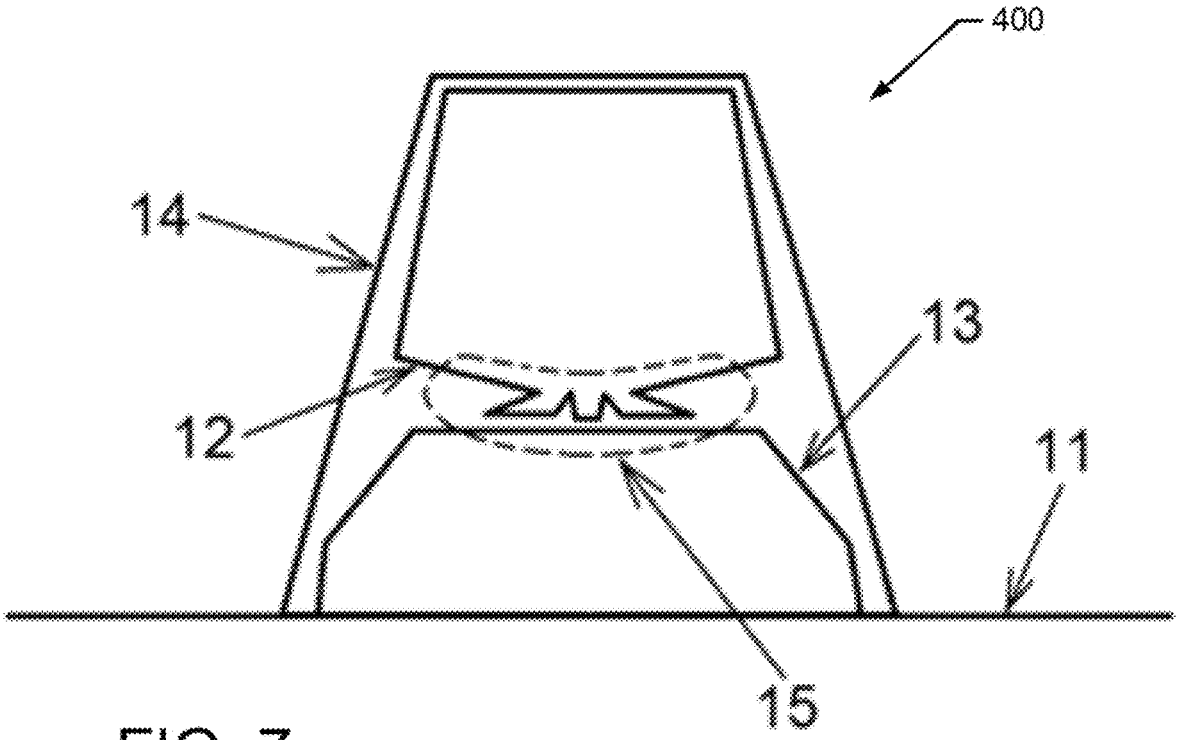
FIG. 7 illustrates a highlighted region of the antenna of FIG. 4 in accordance with an example embodiment.

FIG. 7 illustrates the antenna 400 of FIG. 4, except that a highlighted area 15 is shown by a dotted line, which outlines the highlighted area 15. The highlighted area 15 in FIG. 7 shows areas of high density of current of the antenna 400. Increasing the distance between this point on the antenna element 12 and the ground plane 13 causes a lowering of the maximum gain direction of the antenna 400. The distinctive shapes of the ground plane 13 and the printed circuit board 14, as outlined above, further improve the performance of the antenna 400 as well.

Figure 8:
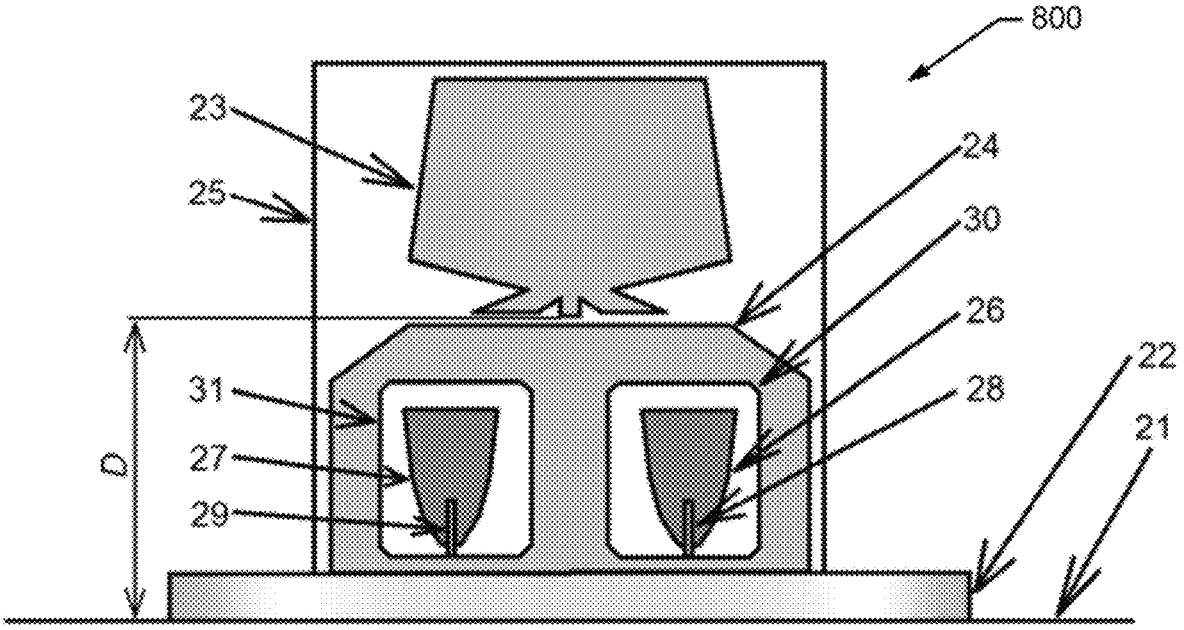
FIG. 8 illustrates a side view of an alternative structure for the antenna in accordance with an example embodiment.
Figure 9:
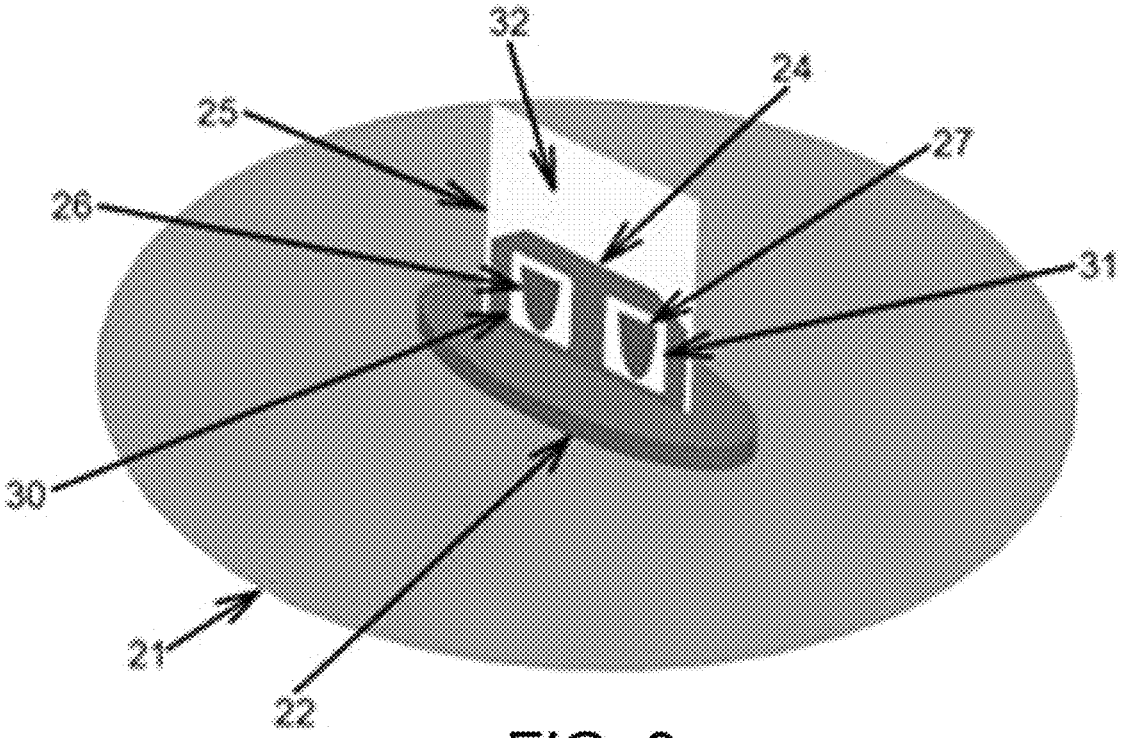
FIG. 9 illustrates an isometric view of the antenna of FIG. 8 from a right side perspective in accordance with an example embodiment.
Figure 10:
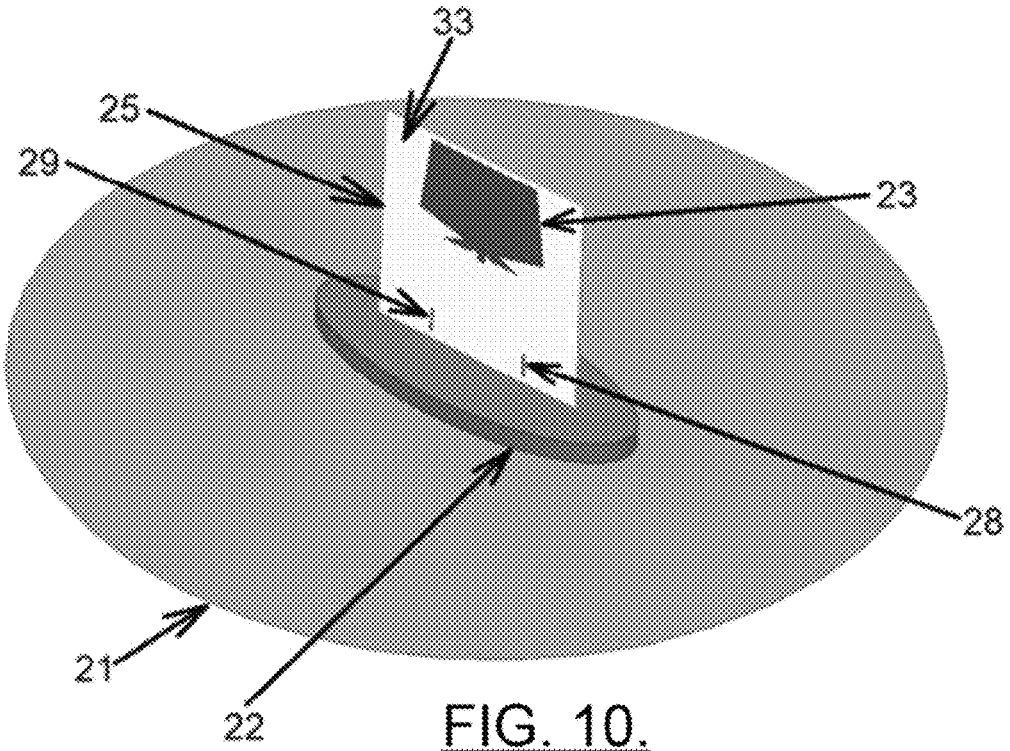
FIG. 10 illustrates an isometric view of the antenna of FIG. 8 from a left side perspective in accordance with an example embodiment.

FIGS. 8-10 relate to MIMO (multiple-input and multiple-output) applications that are explained in greater detail below. As is conventionally understood, in radio applications, MIMO is a method of multiplying the capacity of a radio link using multiple receive and transmit antennas to exploit multipath propagation. The examples of FIGS. 8-10 a MIMO method that uses concepts associated with the antenna 400 of FIG. 4 to generate a useful variant. The variant facilitates the use of N+1 antenna elements connected possibly to N+1 radios at M frequency bands, where M is less than N+1.

The antenna variant of FIGS. 8-10 includes a MIMO antenna 800 that is within one envelop structure that extends over several frequency bands. For the MIMO antenna 800 shown, the frequency bandwidth may be about 0.7 to 5.8 GHz. Each low frequency antenna described herein will further include two additional antennas inside. The lower frequency antenna also contains additional antenna elements inside of a broad band monopole antenna. The lower frequency antenna also contains additional antenna elements inside of broad band monopole antenna to provide isolation greater than 9 dB to maintain proper MIMO operation. Each radiator (i.e., antenna elements 23, 26, 27 described below) may be operably coupled to individual input/output cables connected to a separate radio. In this regard, for example, antenna element 23 may be configured to operate at 0.7 GHz to 2.7 GHz, antenna elements 26 and 27 may be configured to operate over about 2.4 to 5.8 GHz without external or power dividers and/or frequency separators (multiplexers) as required for MIMO operation, thereby providing a good isolation between: a) antenna element 23 and each of the additional antenna elements 26 and 27, and b) between each of additional antenna elements (26 and 27).

The broad band monopole antenna (i.e., MIMO antenna 800) of FIGS. 8-10 includes a planar electrically conductive base surface 21 arranged horizontally, an antenna base 22 installed on the base surface 21 and electrically connected to the base surface 21, and a planar polygonal shaped antenna element 23 arranged vertically and above the antenna base 22 and spaced apart from the base surface 21 by a distance (D). The MIMO antenna 800 may further include a planar polygonal shaped ground plane 24 arranged vertically between the antenna base 22 and below antenna element 23, along with two additional monopole antenna elements 26 and 27 that each have a polygon shape. The MIMO antenna 800 may further include two exciters 28 and 29 that may be conductively in contact with monopole antenna elements 26 and 27. In this example, antenna exciter 28 and 29 and the monopole antenna elements 26 and 27 may be isolated from each other. Exciter 29 is capacitively coupled to monopole 27 and exciter 28 is capacitively coupled to monopole 26. The MIMO antenna 800 further includes a printed circuit board 25 that is arranged vertically on the antenna base 22. In some embodiments, the base surface 21 and Base 22 can be any shape. However, the examples of FIGS. 9 and 10 illustrate the base surface 21 having a circular shape with a diameter of about 18 inches. Meanwhile, in other examples, the base surface 21 could be shaped as a square or various other shapes including shapes selected to improve aerodynamics in situation where aerodynamic characteristics are desirable. Also Base 22 could be shaped as a square or various other shapes including shapes selected to improve aerodynamics in situation where aerodynamic characteristics are desirable.

Ground plane 24 may be electrically connected to the antenna base 22, and the ground plane 24 may further include two polygon open areas (conductor voided) 30 and 31. The antenna base 22 of this example may be made out of aluminum or other conductive metals. Moreover, the antenna base 22 of this example may have a thickness of about 0.3 inches, and an elliptical shape with a length of about 5 inches and width of about 2 inches. In some examples, the printed circuit board 25 may be made out glass-reinforced epoxy laminate material (e.g., FR-4) or an equivalent. The printed circuit board 25 may also have a square shape with dimensions such as a thickness of about 0.028 inches, a height of about 3.2 inches, and a length of about 3.2 inches. The two additional monopole antenna elements 26 and 27 may be located inside of the first and second open areas 30 and 31, respectively, and may be on the same side of antenna element 33. The two exciters 28 and 29 may be configured to have a rectangular plane shape, and may be placed within respective ones of square open areas 30 and 31 and on the 33 side of the printed circuit board 25. The ground plane 24 and two additional monopole antenna elements 26 and 27 may be situated on a first side 32 of the printed circuit board 25. The two exciters 28 and 29 may be located inside of respective ones of the rectangular shaped voided areas 30 and 31. The voided shape is significant to achieve high isolation to antenna element 23 and monopole antenna elements 26 and 27. The two exciters 28 and 29 and antenna element 23 may be situated on the same side (i.e., a second side 33 that is opposite the first side 32) on the printed circuit board 25.

The antenna element 23 may be connected to an output cable at either a first point located in the center of the lowest part of antenna element 23, or at a second point on the top of ground plane 24, which is the closest to the first point.

The additional antenna element 26 may be connected to an output cable at a first point located in the center of the lowest part of exciter 28, or at a second point, which is such point at ground plane 24 (at the bottom of open area 30) that is the closest to the first point. The additional antenna element 27 may be connected to the output cable at a first point located in the center of the lowest part of exciter 29, or at a second point, which is such point at ground plane 24 (at the bottom of open area 31) that is the closest to the first point.

In this example, the antenna element 23 has VSWR≤2.6 in frequencies ranges 0.70-0.96 GHz and 1.70-2.70 GHz. The additional monopole antenna elements 26 and 27 have VSWR≤3 in frequencies ranges 2.40-2.50 GHz and 5.00-5.80 GHz. The coupling between the antenna element 23 and each of the additional antenna elements 26 and 27 in the common frequency range 2.40-2.50 GHz is below −20 dB. The coupling between the additional antenna elements 26 and 27 in the in frequencies ranges 2.40-2.50 GHz and 5.00-5.80 GHz is below −10 dB and −20 dB correspondingly.

Figure 11:
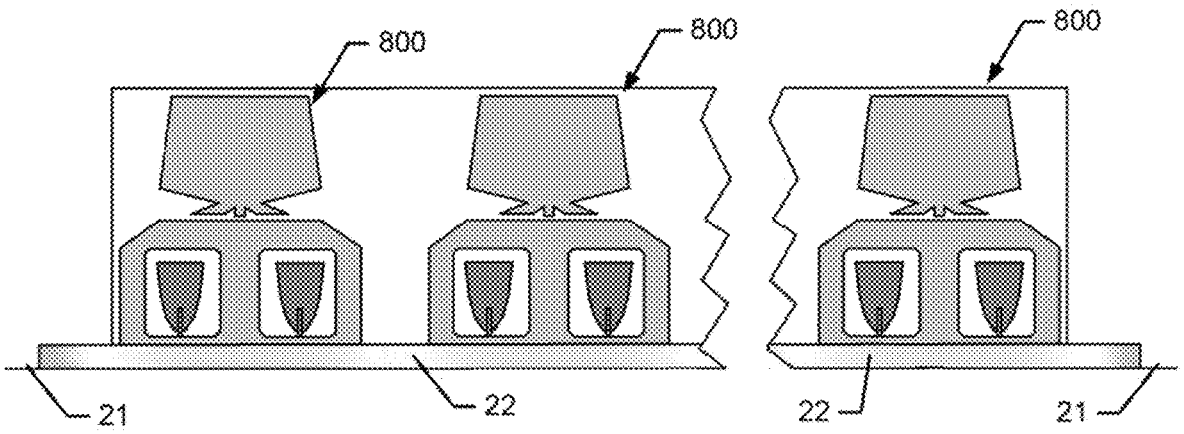
FIG. 11 illustrates the antenna structure including multiple instances of the antenna of FIG. 8 in accordance with an example embodiment.

In an example embodiment, the structures discussed above can be modified to accommodate future 5G networks. For example, N can be larger than 2 and/or the ground plane 24 can be larger than antenna element 23 and therefore contain more than 2 antennas (N). FIG. 11 illustrates an example in which the base surface 21 and antenna base 22 are sized to include multiple instances of the antenna 800 of FIG. 8 above. Thus, there can be K antennas clustered each having N elements inside the vertical ground plane 24. In such an example, M<K*(N+1).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A broad band monopole antenna comprising:

a planar electrically conductive base surface arranged horizontally;

a planar polygonal shaped antenna element arranged vertically spaced above the base surface by a distance (D); and a planar polygonal shaped ground plane arranged vertically between the base surface and said antenna element;

wherein the ground plane is electrically connected to the base surface.

2. The antenna of claim 1, wherein the base surface has a circular shape and a diameter of about 18 inches.

3. The antenna of claim 1, further comprising a printed circuit board arranged vertically on the base surface.

4. The antenna of claim 3, wherein the printed circuit board in made of glass-reinforced epoxy laminate material having an isosceles trapezoid shape.

5. The antenna of claim 4, wherein the isosceles trapezoid shape has dimensions including a thickness of about 0.028 inches, a height of about 3.2 inches, and parallel sides including a top side having a length of about 1.8 inches and a bottom side having a length of about 3.5 inches.

6. The antenna of claim 5, wherein the antenna element and the ground plane are each disposed on the printed circuit board.

7. The antenna of claim 6, wherein an output cable is operably coupled to the antenna at a lowest part of the antenna element.

8. The antenna of claim 6, wherein an output cable is operably coupled to the antenna at a top portion of the ground plane opposite a lowest part of the antenna element.

9. The antenna of claim 1, wherein the antenna element is configured to have a maximum gain at about 20 degrees of elevation from the horizon.

10. A broad band monopole antenna comprising:

a planar electrically conductive base surface arranged horizontally;

a planar polygonal shaped antenna element arranged vertically spaced above the base surface by a distance (D);

a planar polygonal shaped ground plane arranged vertically between the base surface and the antenna element; and N additional antenna elements, where N is a positive integer, wherein the ground plane is electrically connected to the base surface, and has N opened areas;

wherein one of each of the N additional antenna elements is installed in each respective one of the N opened areas in the ground plane.

11. The antenna of claim 10, wherein the N opened areas are configured to isolate the antenna element from the N additional antenna elements, and isolate the N additional antenna elements from each other.

12. The antenna of claim 10, further comprising a printed circuit board arranged vertically on an antenna base installed at the base surface.

13. The antenna of claim 12, wherein the printed circuit board in made of glass-reinforced epoxy laminate material having a rectangular shape.

14. The antenna of claim 13, wherein the rectangular shape has dimensions including a thickness of about 0.028 inches, a height of about 3.2 inches, and a length of about 3.2 inches.

15. The antenna of claim 14, further comprising an exciter corresponding to each of the N additional antenna elements, each corresponding exciter being disposed inside a respective one of the N opened areas.

16. The antenna of claim 15, wherein the N additional antenna elements and each corresponding exciter are disposed on opposite sides of the printed circuit board.

17. The antenna of claim 15, wherein an output cable is operably coupled to the N additional antenna elements at a center of a lowest part of each corresponding exciter, or at a point on the ground plane that is closest to the center of the lowest part of each corresponding exciter.

18. The antenna of claim 16, wherein antenna element and the each corresponding exciter are disposed on the same side of the printed circuit board.

19. The antenna of claim 18, wherein an output cable is operably coupled to the antenna at a lowest part of the antenna element.

20. The antenna of claim 18, wherein an output cable is operably coupled to the antenna at a top portion of the ground plane opposite a lowest part of the antenna element.

* * * * *